US006254090B1

(12) United States Patent
Rhodes et al.

(10) Patent No.: US 6,254,090 B1
(45) Date of Patent: Jul. 3, 2001

(54) VACUUM CONTROL FOR VACUUM HOLDDOWN

(75) Inventors: John D. Rhodes; Steve O. Rasmussen, both of Vancouver, WA (US); Angela Chen, Portland, OR (US); Geoff Wotton, Battleground, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/292,125

(22) Filed: Apr. 14, 1999

(51) Int. Cl.[7] ..... B65H 5/08
(52) U.S. Cl. ..... 271/276; 271/96; 271/265.01
(58) Field of Search ..... 271/276, 94, 96, 271/196, 176, 265.01; 355/73

(56) References Cited

U.S. PATENT DOCUMENTS

| | | | | |
|---|---|---|---|---|
| 3,617,127 | | 11/1971 | McDuff | 355/73 |
| 4,145,040 | | 3/1979 | Huber | 271/276 |
| 4,202,542 | | 5/1980 | Lammers et al. | 271/276 |
| 4,237,466 | | 12/1980 | Sranton | 346/75 |
| 4,294,540 | | 10/1981 | Thettu | 355/76 |
| 4,451,197 | * | 5/1984 | Lange | 271/265.01 |
| 4,504,843 | | 3/1985 | Prohl et al. | 346/138 |
| 4,792,249 | | 12/1988 | Lahr | 400/578 |
| 4,878,071 | | 10/1989 | Bibl et al. | 346/153.1 |
| 4,921,240 | | 5/1990 | Watson | 271/245 |
| 4,926,199 | | 5/1990 | Bibl et al. | 346/157 |
| 4,952,950 | | 8/1990 | Bibl et al. | 346/157 |
| 4,982,207 | | 1/1991 | Tunmore et al. | 346/138 |
| 5,037,079 | | 8/1991 | Siegel et al. | 271/3 |
| 5,124,728 | | 6/1992 | Denda | 346/134 |
| 5,183,252 | | 2/1993 | Wolber et al. | 271/276 |
| 5,197,812 | | 3/1993 | Worley et al. | 400/635 |
| 5,294,965 | | 3/1994 | May | 355/312 |
| 5,383,001 | | 1/1995 | Bosy | 355/73 |
| 5,510,822 | | 4/1996 | Vincent et al. | 347/102 |
| 5,717,446 | | 2/1998 | Teumer et al. | 347/35 |
| 5,771,054 | | 6/1998 | Dudek et al. | 347/102 |
| 6,086,064 | * | 7/2000 | Biegels et al. | 271/265.01 |

* cited by examiner

*Primary Examiner*—H. Grant Skaggs

(57) ABSTRACT

A mechanism for manifolding a vacuum force to separate surface sectors of a vacuum holddown uses subsurface ducting to apply the vacuum to separate subsurface vacuum plenums wherein each is fluidically coupled to a separate surface sectors. The plenum is segregated by a diaphragm into surface side and vacuum side cavities. Trigger ports and appropriate ducting through the holddown subjacent the surface associated with each sector determine how the vacuum is routed. Only when a trigger port is covered is the vacuum routed to the surface sector associated therewith. The system can be implemented in planar or curvilinear constructs and be provided with features to accommodate a near-continuous range of flexible material sizes. A specific implementation in an ink-jet hard copy apparatus is also described.

20 Claims, 9 Drawing Sheets

VACUUM CONTROL FOR VACUUM HOLDDOWN

RELATED APPLICATIONS

This application is related to co-filed U.S. patent application Ser. No. 09/292,767, by Steve 0. Rasmussen et al., for a Print Media Vacuum Holddown; and U.S. patent application Ser. No. 09/292,838, by Geoff Wotton et al., for a Vacuum Surface for Wet Dye Hard Copy Apparatus.

BACKGROUND OF THE INVENTION

1. Field of the Invention

The present invention relates generally to vacuum holddown devices, more specifically to a method and apparatus for a print media holddown using a vacuum force, and particularly to automatically adapting a holddown for various print media sizes used by a hard copy apparatus employing wet dye printing.

2. Description of Related Art

It is known to use a vacuum induced force to adhere a sheet of flexible material to a surface, for example, for holding a sheet of print media temporarily to a platen. [Hereinafter, "vacuum induced force" is also referred to as "vacuum induced flow," "vacuum flow," or more simply as just "vacuum" or "suction".] Such vacuum holddown systems are a relatively common, economical technology to implement commercially and can improve throughput specifications. For example, it is known to provide a rotating drum with holes through the surface wherein a vacuum through the drum cylinder provides a suction force at the holes in the drum surface. [The term "drum" as used hereinafter is intended to be synonymous with any curvilinear implementation incorporating the present invention; while the term "platen" can be defined as a flat holding surface, in hard copy technology it is also used for curvilinear surfaces, such as a common typewriter rubber roller; thus, for the purposes of the present application, "platen" is used generically for any shape paper holddown surface used in a hard copy apparatus.]

In a hard copy apparatus, such as a copier or a computer printer, a platen is used either to transport cut-sheet print media to an internal printing station or to hold the sheet media at the printing station while images are formed, or both. [In order to simplify discussion, the term "paper" is used hereinafter to refer to all types of print media; no limitation on the scope of the invention is intended nor should any be implied.] One universal problem is the management of different sized paper. Open holes around the edges of a sheet smaller than the dimensions of the vacuum field in the platen surface results in vacuum losses for holding the paper. In other words, too many exposed vacuum ports results in a change of the flow forces in each vacuum port and a loss of holding pressure at covered ports. Thus, a sheet of paper that is smaller than the total vacuum field is not firmly adhered to the surface. Known apparatus generally rely on a user manually switching operational functions to adjust the vacuum field to match the size of the paper in current use.

Another problem has become evident as attempts have been made to employ vacuum for holding paper in "wet" printing environments, that is, in hard copy apparatus such as in an ink-jet printer that uses a liquid dye. [The terms "liquid dye," or "wet dye" or just "dye" is used herein as generic for all such hard copy apparatus, whether employing ink (which may itself be dye-based or pigment-based), a wet toner, or other liquid colorant.] The art of ink-jet technology is relatively well developed. Commercial products such as computer printers, graphics plotters, copiers, and facsimile machines employ ink-jet technology for producing hard copy. The basics of this technology are disclosed, for example, in various articles in the *Hewlett-Packard Journal,* Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in *Output Hardcopy* [*sic*] *Devices,* chapter 13 (Ed. R. C. Durbeck and S. Sherr, Academic Press, San Diego, 1988).

For example, with a drum surface employing a field of discrete vacuum holes, the localized vacuum pressure against the underside of the paper draws the wet dye through the capillaries of the paper material before the dye has time to set. This results in alternating dark and light concentrations of dye in the final image correlating to the individual influence regions of the holes in the field. Moreover, in an ink-jet environment, air flow due to vacuum forces through ports around the periphery of the paper could affect ink drop firing trajectories, resulting in misprints or random artifacts in the final image.

Another problem occurs in ink-jet printing when the pen-to-paper spacing varies across the surface of the paper. If this spacing variation is rapid, print defects occur due to droplet trajectory errors and flight time differences. Such spacing variation occurs if the paper is locally deformed by vacuum ports of significant size, e.g., greater than about one to two millimeters.

There is a need for a vacuum holddown that can automatically adjust to a relatively universal variety of sizes of a flexible material. The holddown system should operate while being moved at a relatively high speed (e.g., for a drum rotating at approximately 30-inches/second). Moreover, there is a need for a vacuum paper holddown that is suited for use in a wet dye printing environment.

SUMMARY OF THE INVENTION

In its basic aspects, the present invention provides an apparatus for receiving and holding a flexible material sheet thereon, the apparatus including a mechanism for producing a vacuum, and further including: a mechanism for receiving and holding the flexible material on a first surface, the first surface having a plurality of sectors wherein each of the sectors has associated therewith a mechanism for triggering ducting of a vacuum force from the mechanism for producing a vacuum to each of the sectors respectively; a plurality of mechanisms for containing a vacuum subjacent the surface, one mechanism for containing a vacuum associated with each of the plurality of sectors, respectively, wherein each mechanism for containing a vacuum is fluidically coupled to an individual one of the sectors; and a mechanism for manifolding the vacuum force from the mechanism for producing a vacuum to the plurality of mechanisms for containing a vacuum such that when the mechanism for triggering is open to atmospheric pressure the mechanism for contain a vacuum is in a first state wherein no vacuum force is passed through to the one of the sectors associated with the mechanism for triggering open to atmospheric pressure, and when the mechanism for triggering is covered by the flexible material the mechanism for containing a vacuum is in a second state wherein the vacuum force is passed through to the one of the sectors associated with the mechanism for triggering closed to atmospheric pressure.

In another basic aspect, the present invention provides a method for securing variably sized, individual sheets of print media to a platen surface using vacuum mechanism for generating a vacuum force. The method includes the steps of: providing a platen having surface with a plurality of discrete vacuum channels therein wherein the channels are arranged in sets associated with discrete sectors of the surface, each of the channels being fluidically coupled by a passageway through the platen to one of a plurality of vacuum plenum chambers subjacent the surface wherein one of the vacuum plenum chambers is associated with each of the sets, the plenum chamber having a mechanism for opening and closing the passageway and for segregating the chamber into an exterior region and an interior region, wherein the mechanism for opening and closing is biased to a passageway-open position against atmospheric pressure and is pulled to a passageway-closed position when the vacuum force is manifolded to the exterior region, wherein the platen surface has length and width dimensions for sequentially accommodating different sized print media, and wherein the surface has at least one vacuum port associated with each of the sets fluidically coupled to the mechanism for generating vacuum force; subjecting each of the plenum chambers to the vacuum force via the exterior region, the vacuum force having a predetermined value sufficient for closing the passageways by moving the mechanism for opening and closing to the passageway-closed position such that a substantially atmospheric pressure condition exists within passageways and channels associated therewith; and transporting a sheet of print medium onto the platen surface wherein by interaction of the sheet of print medium with the vacuum ports where the print medium is in contact with the platen surface, vacuum ports covered by the sheet of print media have the mechanism for opening and closing automatically moved to the passageway-open position due to change in pressure differential between the exterior region and the interior region of the plenum chamber thereby securing the sheet to the surface.

In yet another basic aspect, the present invention provides a cut-sheet print medium holddown device for a hard copy apparatus having a mechanism for exerting a vacuum force, the device including: a platen having a platen outer surface having an area sufficient for sequentially accommodating different size print media sheets thereon and a plurality vacuum channels distributed thereon as discrete sets of vacuum channels, a platen inner surface, and a plurality of vacuum trigger ports fluidically coupling the platen outer surface and the platen inner surface with at least one vacuum trigger port associated with each of the discrete sets of vacuum channels; a plurality of vacuum plenum chambers subjacent the platen, each of the chambers having at least one fluidic coupling to one of the discrete sets of vacuum channels; a manifold for distributing the vacuum force from the mechanism for exerting a vacuum force to the plenum chamber and for fluidically coupling the vacuum trigger ports from the platen inner surface to the vacuum plenum chambers such that each of the chambers is separately coupled to one of the discrete sets of vacuum channels and the trigger port associated therewith; a plurality of vacuum plenum valves wherein one of the plurality of vacuum plenum valves is mounted within each of the vacuum plenum chambers such that print media sheet coverage of individual vacuum trigger ports causes a pressure differential change across only the vacuum plenum valves associated with the sheet-covered vacuum trigger ports fluidically coupled thereto, automatically moving the vacuum plenum valves associated with sheet-covered vacuum trigger ports from a closed position to an open position such that the vacuum force is exerted only through vacuum channels associated with sheet-covered vacuum ports.

In still another basic aspect, the present invention provides an ink-jet hard copy apparatus, having a vacuum mechanism for generating a vacuum force, wherein the apparatus is adapted for using cut-sheet print media of different sizes. The apparatus includes: a platen having an inner surface fluidically coupled to the vacuum mechanism and an outer surface for receiving various sized print media thereon; a manifold for coupling discrete sectors of the outer surface to the vacuum mechanism; a plurality of vacuum operated valves, mounted in the manifold such that each of the discrete sectors is individually coupled to the vacuum force through a respective valve associated with the individual one of the discrete sectors, each of the vacuum operated valves having a first position in which a respective one of the discrete sectors is cut-off from the vacuum force and a second position in which the respective one of the discrete sectors is coupled to the vacuum force; and a plurality of vacuum-actuated trigger ports through the platen, fluidically coupled to the vacuum mechanism and to respective ones of the vacuum operated valves associated with a respective one of the discrete sectors, one each of the trigger ports associated with one of the discrete sectors such that covering a trigger port with a region of the print media changes a pressure differential between atmospheric pressure and the vacuum force across the valve such that the valve is moved from the first position to the second position.

In another basic aspect, the present invention provides a vacuum holddown including: a drum having a surface for receiving and capturing cut-sheet print media of various sizes thereon wherein the surface is divided into individual sectors; a vacuum manifold coupled to the drum; at least one valve mechanism coupled to the manifold for valving a suction force to the individual sectors; and associated with each of the sectors, at least two related vacuum trigger port mechanisms for activating the valve mechanism including, a first vacuum trigger port mechanism located with respect to the associated sector for being covered by a leading edge of the cut-sheet print media and a second vacuum trigger port mechanism located with respect to the associated sector for being covered by a trailing edge of the cut-sheet print media wherein each of the vacuum trigger port mechanisms includes a mechanism for closing a related vacuum trigger port mechanism whenever one of the two related vacuum trigger port mechanisms is covered by the cut-sheet print media.

It is an advantage of the present invention that it provides a vacuum holddown that automatically adjusts to the size of the held material.

It is a further advantage of the present invention that it employs a single valving device in conjunction with a plurality of vacuum force distribution mechanisms, simplifying manufacture.

It is a further advantage of the present invention that it limits vacuum waste, reducing vacuum power requirements.

It is a further advantage of the present invention that it permits a higher vacuum power, allowing stiffer media to be held.

It is an advantage of the present invention that it distributes vacuum forces substantially evenly across a sheet of paper being held, thus eliminating localized deformations.

It is an advantage of the present invention that it distributes vacuum forces substantially evenly across a sheet of paper being held, thus is suited to use in a wet dye printing apparatus.

Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention. Alternative embodiments are also briefly described as applicable. The description hereinafter is made with respect to hard copy apparatus embodiments. However, it will be recognized by those skilled in the art that the holddown described can be used with almost any flexible material, e.g. for transporting relatively large sheets of metal, cardboard, and the like. For convenience of explanation, the present invention will be described with respect to exemplary embodiments comprising hard copy apparatus using cut-sheet print media. It is to be recognized that the invention has a wider applicability. The use of hard copy apparatus exemplary embodiments is not intended as a limitation on the scope of the invention, nor should any such limitation be implied therefrom.

Figure 1A:
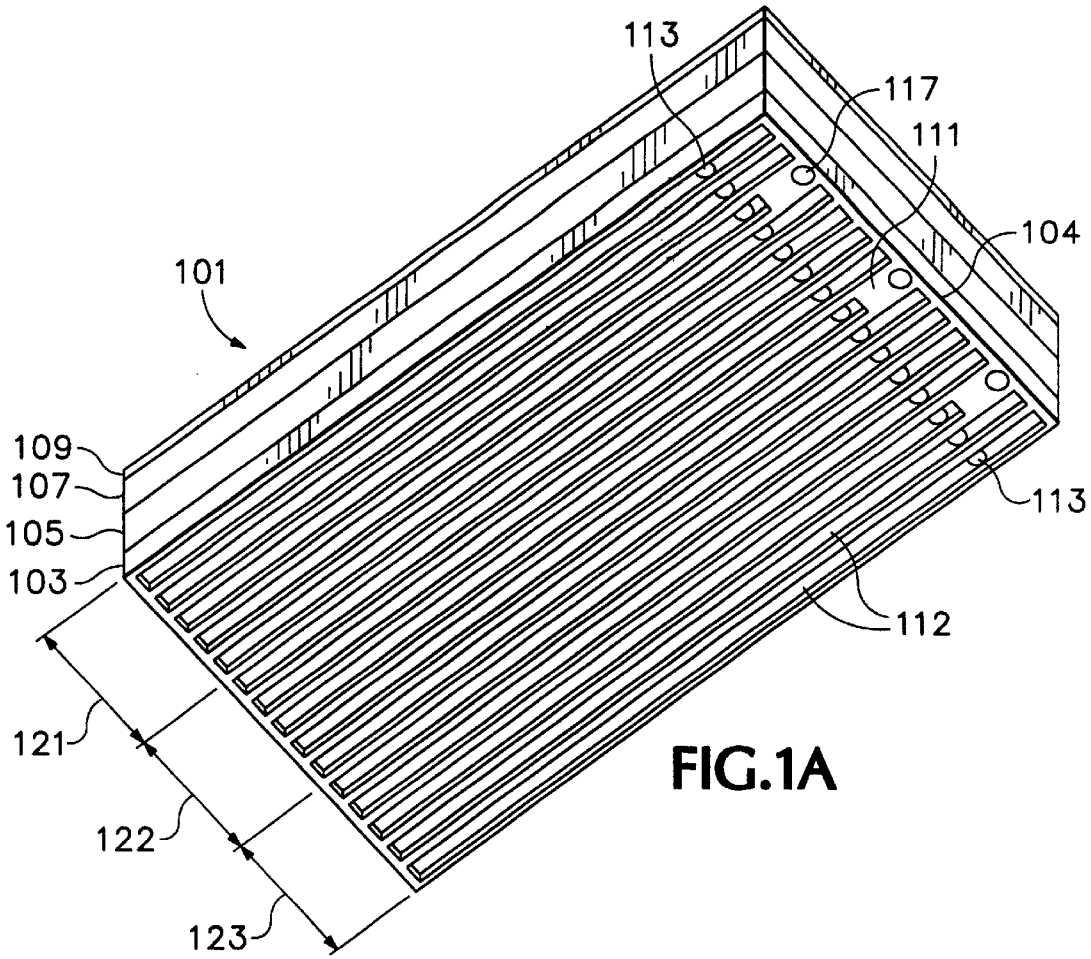
FIG. 1A is a perspective view (top) drawing of a vacuum holddown in accordance with the present invention.
Figure 1B:
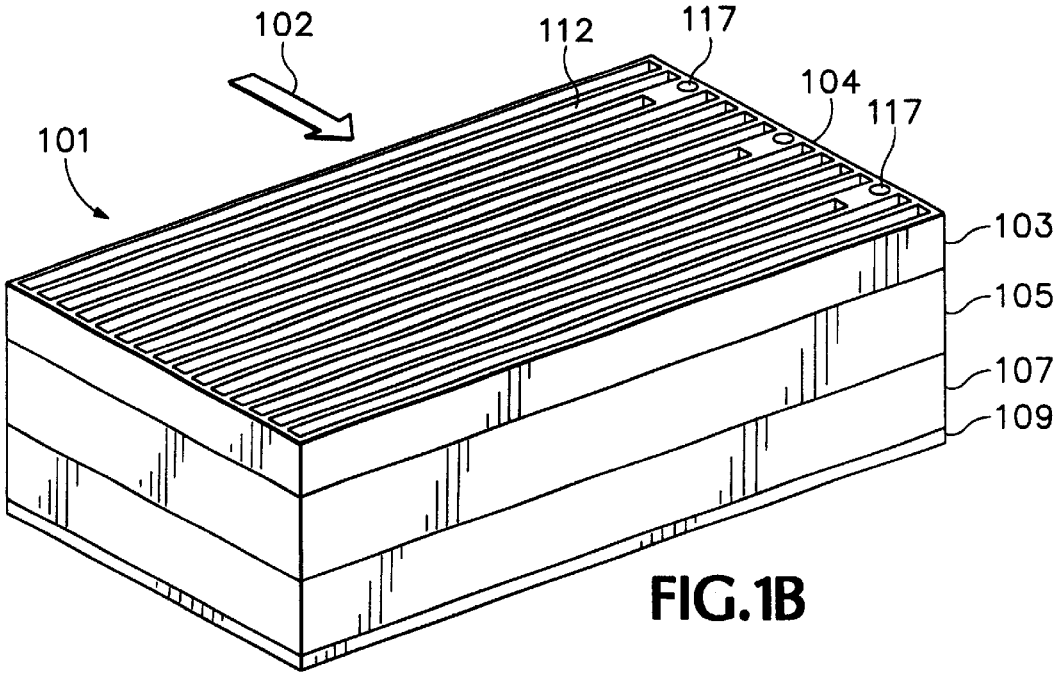
FIG. 1B is a perspective view (bottom) drawing of a vacuum holddown in accordance with the present invention as shown in FIG. 1A.

FIGS. 1A, and 1B depict an assembled flexible material holddown 101, for use in a hard copy apparatus, including a receiving and holding plate, or "platen," 103, a vacuum gate valve plate 105, a vacuum manifold 107, and a base plate 109. The vacuum force can be implemented using any state of the art known manner, such as with an exhaust fan mechanism. The paper feed directionality is indicated by arrow 102, FIG. 1B. In this embodiment, the paper being fed to the platen 103 is edge-aligned to the side edge 104 of the holddown 101.

Figure 2A:
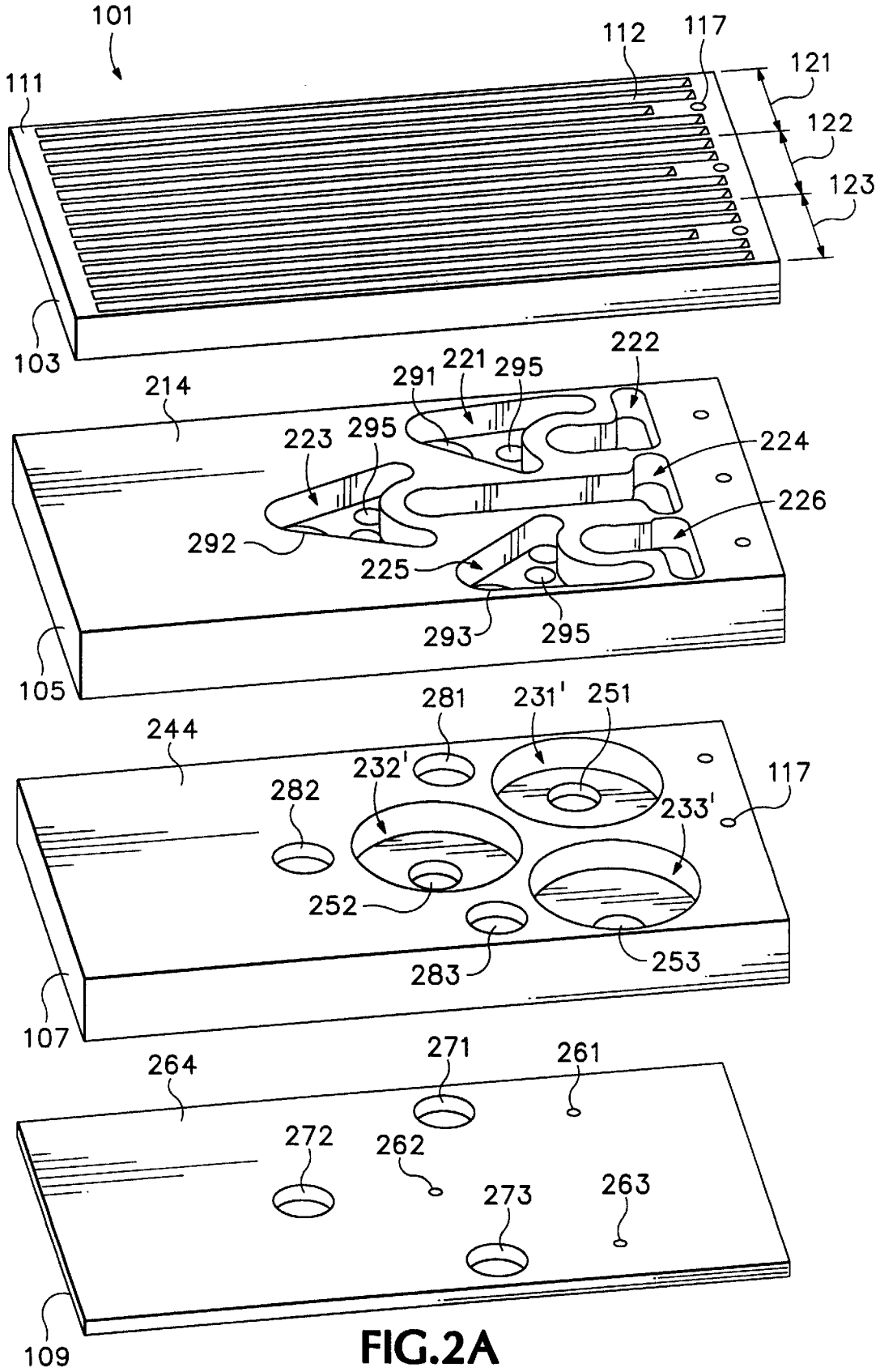
FIG. 2A is an exploded, perspective view (top) drawing of a vacuum holddown in accordance with the present invention as shown in FIGS. 1A and 1B.
Figure 2B:
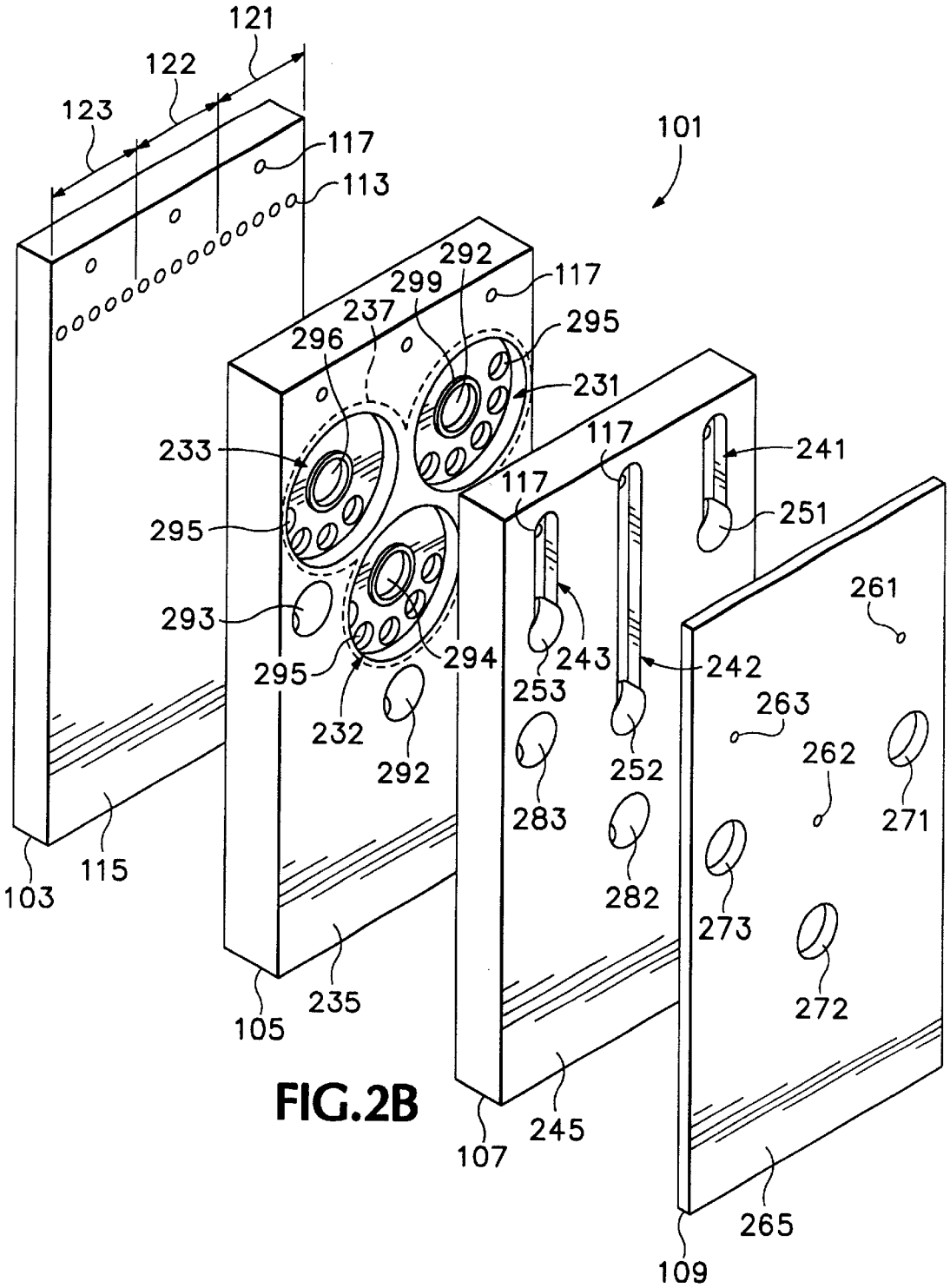
FIG. 2B is an exploded, perspective view (bottom) drawing of a vacuum holddown in accordance with the present invention as shown in FIGS. 1A, 1B and 2A.
Figure 2C:
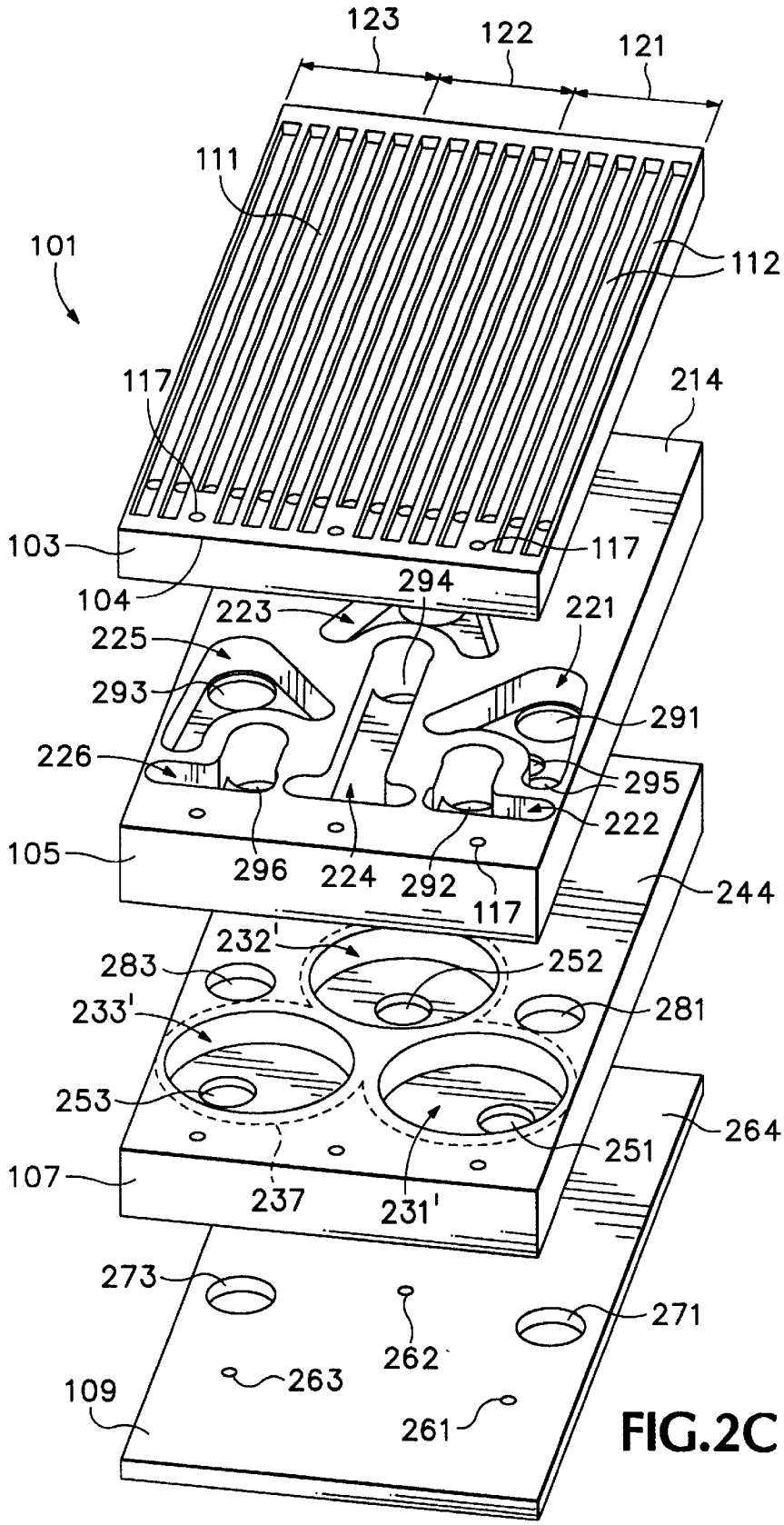
FIG. 2C is an exploded, perspective view (top) drawing of a vacuum holddown in accordance with he present invention as shown in FIG. 2A and 2B, from a different angle than FIG. 2A.

Referring now also to FIGS. 2A, 2B, and 2C, the platen 103 includes a plurality of vacuum through-holes, or "vacuum ports," 113, with each port fluidically coupled for air flow to an associated vacuum channel 112, FIGS. 2A and 2C only, in the outer surface 111 of the platen 103. Whereas a vacuum port 113 extend from the floor of its associated channel 112 through the platen 103 to platen 103 inner surface 115 (FIG. 2B only), the channels 112 do not. [The term "inner" as used hereinafter is meant to be synonymous with the side of the construct or the direction from which the vacuum is applied.] Thus, a vacuum draw into the holddown 101 via the vacuum ports 113 distributes the suction force across the outer surface 111 via the channels 112. Vacuum distribution trigger ports 117 adjacent outer surface 111 edge 104 and adjacent one end of the channels 112 are each associated with a plurality of vacuum ports 113 and their respective vacuum channels 112. In the depicted embodiment, the platen surface 111 is divided into three sectors 121, 122, 123. Each sector 121–123 has a vacuum trigger port 117 and a set of five pairs of vacuum ports 113 and their respectively associated vacuum channels 112. A specific implementation can modify the surface 111 layout design and the relative dimensions of the channels, vacuum ports 113, and vacuum trigger ports 117 in accordance with specific needs. Similarly, the vacuum source specifications are also any design expedient with a specific implementation.

Figure 5:
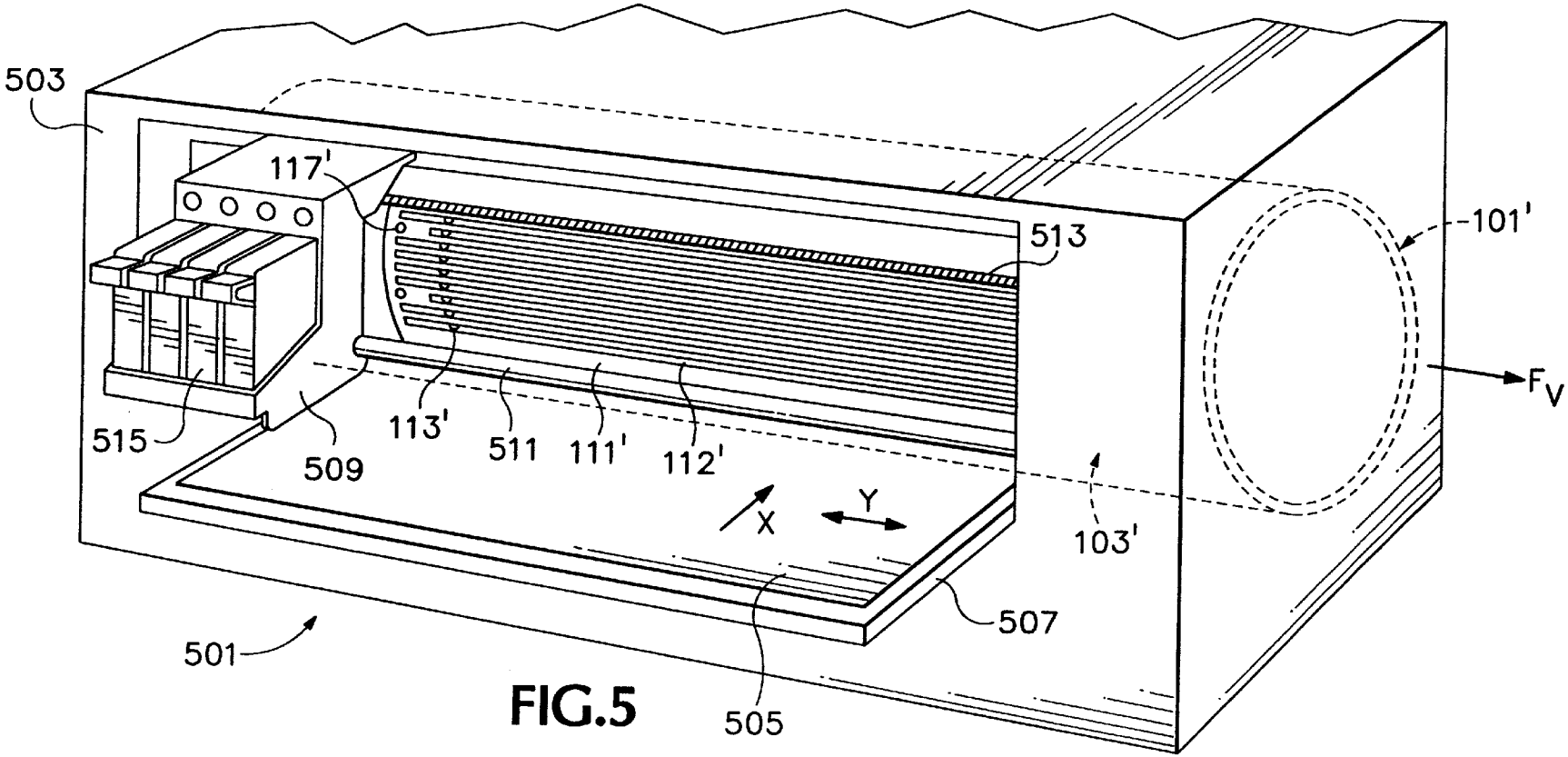
FIG. 5 is an ink-jet hard copy apparatus in accordance with the present invention and employing the method and apparatus demonstrated in FIGS. 1A through 4E.

While the holddown 101 is shown as a planar construct, it is to be recognized that a specific implementation of the present invention can assume other shapes, such as a rotating drum construction, such as where the base plate 109 would constitute the inner surface layer of the drum and the holddown 101 construct forming a cylinder through which a vacuum force is applied. Referring briefly to FIG. 5, in a preferred embodiment, the platen 103' and its subjacent assembly is formed as the cylindrical drum holddown 101' with the channels 112' oriented parallel to the axis of the cylinder and lying in the cylindrical surface.

Referring back to FIGS. 1A through 2C, the vacuum gate valve plate 105 is subjacently mounted by any suitable known manner manufacturing technique to the inner surface 115 of the platen 103. Looking specifically to FIGS. 2A and 2C, the outer surface 214 of the gate valve plate 105, which will be adjacent the underside, inner surface 115 of platen 103, includes a set of six outer vacuum distribution cavities 221, 222, 223, 224, 225, 226 arranged in three pairs 221/222, 223/224, 225/226 to correspond with the platen 103 vacuum distribution three platen surface 111 sectors 121, 122, 123, respectively. The sector trigger ports 117 are a continuous fluidic passageway from the platen 103 outer surface 111 through the platen 103 and then through the gate valve plate 105, emerging from its inner surface 235, FIG. 2B. Looking specifically to FIG. 2B, the inner surface 235 of the gate valve plate 105 has a set of three inner vacuum distribution cavities 231, 232, 233 which will act as vacuum plenums such that one plenum is associated with each of the platen sectors 121, 122, 123. Each of the inner vacuum distribution cavities 231, 232, 233 are fluidically coupled by ports 295 which form air flow passageways back through the gate valve plate 105 to three of the outer vacuum distribution cavities 221, 223, 225 in the outer surface 214 of the gate valve plate 105 as seen in FIGS. 2A and 2C. The other three outer vacuum distribution cavities 222, 224, 226 of each pair 221/222, 223/224, 225/226 are in turn fluidically coupled by a separate gated passageway 292, 294, 296 to their individually associated inner vacuum distribution cavities 231, 232, 233 (FIG. 2B only), thus coupling the platen 103 vacuum ports 113 of each of the sectors 121, 122, 123 with their associated channels 112 to the inner vacuum distribution cavities 231, 232, 233. In this manner, as will be explained in more detail with respect to FIG. 3A and 3B hereinafter, the gate valve plate 105 forms part of the gated vacuum plenums and part of the manifolding from the vacuum source to the platen 103 surface channels 112. A flexible diaphragm 237 covers the inner vacuum distribution cavities 231–233 as shown in transparent form in FIG. 2B and in phantom line in FIG. 2C covering three aligned manifold 107 outer vacuum distribution cavities 231', 232', 233' adjacent to the gate valve plate inner vacuum distribution cavities, respectively. Thus, when assembled, the aligned respective pairs 231/231', 232/232', 233/233' of vacuum distribution cavities of the gate valve plate 105 and the manifold 107, respectively, are segregated by the diaphragm 237 and form a segregated vacuum plenum chamber from which the vacuum is ultimately distributed to the surface 111 channels 112 of the platen 103.

The manifold 107 is subjacently mounted by any suitable known manner manufacturing technique to the inner surface 235 (FIG. 2B only) of the gate valve plate 105. Returning to FIG. 2A, the manifold 107 has a outer surface 244 which includes the three outer vacuum distribution cavities 231', 232', 233' which align with the three inner vacuum distribution cavities 231, 232, 233, respectively, in the underside, inner surface 235 of the gate valve plate 105. Each of the three trigger ports 117 individually continue from the inner surface 235 of the gate valve plate 105 into the adjoining outer surface 244, FIGS. 2A and 2C only, of the manifold 107. Looking to FIG. 2B, the inner surface 245 of the manifold 107 has three cavities that form trigger channels 241, 242, 243 which fluidically couple the trigger ports 117 to the manifold 107 outer vacuum distribution cavities 231', 232', 233', respectively, via respective cavity floor holes 251, 252, 253. Looking to FIGS. 2A and 2B, this creates a continuous fluidic connection from the platen surface 111 into the trigger ports 117, inwardly through the platen 103, continuing through the gate valve plate 105, through the manifold 107, then turning in the plane of the holddown 101 construction along the trigger channels 241–243 and back outwardly into the manifold outer vacuum distribution cavities 231'–233' on the inner side of diaphragm 237 that is between the manifold 107 and the gate valve plate 105 and which separates cavities 231/231', 232/232', 233/233' into respective outer and inner vacuum plenum regions. In other words, there is a fluidic coupling between the surface 111 trigger port 117 orifice and the inner region of each of the segregated vacuum distribution cavities 231/231', 232/232', 233/233'. Three other apertures 281, 282, 283 are provided through the manifold 107, the purpose of which is explained hereinafter. The associated cavities and apertures in the manifold 107 are also aligned to act individually in pairs with respect to aligned platen surface 111 sectors 121, 122, 123.

The base plate 109 is subjacently mounted by any suitable known manner manufacturing technique to the inner surface 245 (FIG. 2B only) of the manifold 107. The inner surface 265 of the base plate 109 is the surface that is initially exposed to the vacuum force. The base plate has six apertures 261, 262, 263, 271, 272, 273 extending from the vacuum side surface 265 to an outer surface 264 (FIG. 2A and 2C) which, when assembled, is adjacent the manifold 107 inner surface 245 (FIG. 2B). Again, these apertures are also paired 261/271, 262/272, 263/273 to act individually with respectively aligned platen surface 111 sectors 121, 122, 123. Three of the base plate 109 apertures 261, 262, 263 are relatively small diameter "bleed holes," aligned and fluidically coupled with superjacent manifold 107 trigger channels 241, 242, 243, respectively, thus subjecting the trigger channels to the vacuum force at all times of operation. The other three base plate 109 apertures 271, 272, 273 are relatively large diameter vacuum-pull holes and, when the holddown 101 is assembled, are in direct alignment with three holes 281, 282, 283, respectively, through the manifold 107 which are in turn aligned with three holes 291, 292, 293, respectively, of the valve gate plate 105 which then open into three outer vacuum cavities 221, 223, 225 (FIG. 2A) in the outer surface 214 of the valve gate plate 105. These three outer vacuum cavities 221, 223, 225 are each provided with a plurality of the vacuum ports 295 which fluidically couple to the gate valve plate 105 three inner vacuum distribution cavities 231, 232, 233, respectively, in the outer surface 235 of the gate valve plate on the outer side of diaphragm 237. In other words, the aligned vacuum pull holes are arranged in triplets 271/281/291, 272/282/292 to form a vacuum passageway from the base plate vacuum side 265 (FIG. 2B) of the base plate 109 all the way up through the construction to the outer side of the diaphragm 237 (FIG. 2C only).

The vacuum fluidic circuit is completed from the platen 103 vacuum ports 113 to the vacuum side of base plate 109 by aligning the three sector's 121, 122, 123 vacuum ports 113 respectively to the three outer vacuum distribution cavities 231, 232, 233 of the gate valve plate 105 via three outer vacuum distribution cavities 222, 224, 226 which are configured to form "vacuum port channels" 222, 224, 226 in the outer surface 214 of the gate valve plate 105 by providing three relatively large center holes 292, 294, 296, only seen in FIG. 2B and 2C, through the gate valve plate, thereby fluidically coupling three outer vacuum port channels 222, 224, 226 to the outer side of diaphragm 237 spanning and separating the vacuum distribution cavities 231/231', 232/232', 233/233' of the combined valve gate plate 105 and manifold 107. The vacuum side circumference of each center hole 292, 294, 296 is provided with a valve seat, or "lip seal," 299 (FIG. 2B only).

Figure 3A:
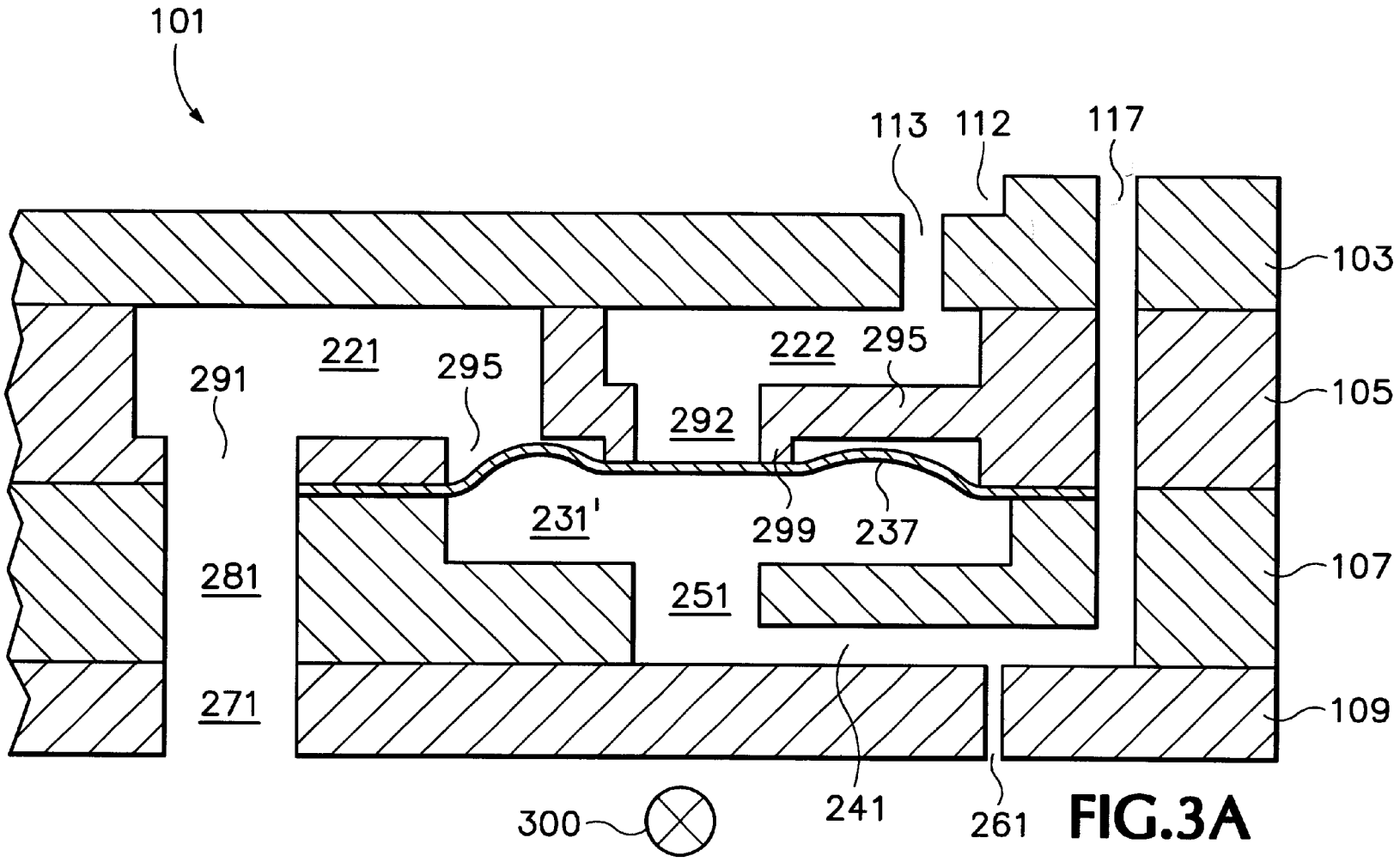
FIGS. 3A and 3B are a schematic drawings demonstrating the operation of a vacuum control valve of the present as shown in FIGS. 1A through 2C.
Figure 3B:
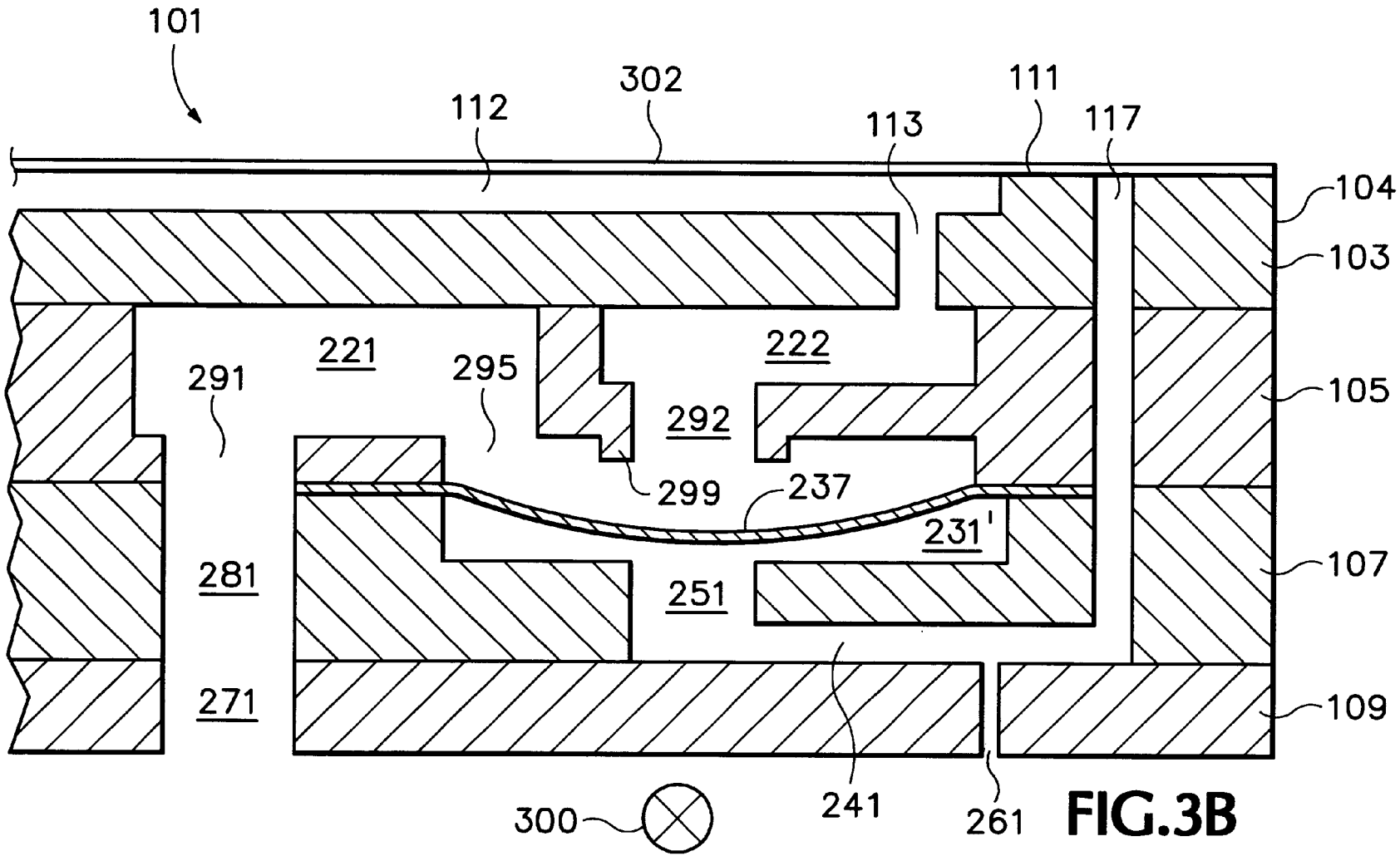

The vacuum fluidic circuit and the operation of an assembled holddown 101 are shown schematically in FIGS. 3A and 3B. The vacuum force is illustrated by arrow tail 300. FIG. 3A represents one trigger-activated gate valve device of a holddown 101 in accordance with the present invention in a trigger open, gate valve closed condition, e.g., for surface 111 sector 121, FIGS. 2A–2C. FIG. 3B represents the same trigger-activated gate valve device in accordance with the present invention in a trigger closed, gate valve open condition.

With the trigger port 117 open, that is, when there is no paper covering the trigger port, when a vacuum force 300 is applied, atmospheric pressure exists above the trigger port. The bleed hole 261 of the base plate 109 is of a relatively very small diameter when compared to the larger trigger port 117 and the platen 103 vacuum port 113. The vacuum force 300 is applied to the construction with a predetermined value that pulls the diaphragm 237 outwardly and up to a position where it will contact the lip seal 299. That is, the vacuum has a wide pathway via the base plate 109 vacuum pull aperture 271, the manifold aperture 281 aligned therewith, and the aligned valve gate plate 105 aperture 291 into the valve gate plate 105 outer vacuum distribution cavity 221; this is in turn communicated via valve gate plate 105 vacuum ports 295 into the valve gate plate 105 inner vacuum distribution cavity 231 pulling the diaphragm 237 up against the lip seal 299 of center hole 292. The vacuum pull through the bleed hole 261 is negligible in comparison. Thus, the open trigger port 117 results in the closing off of its associated set of five vacuum ports 113 and their respective associated surface channels 112 to the vacuum force 300 as the diaphragm is pulled against the lip seal 299. Via the vacuum port 113, the valve gate plate 105 outer vacuum port channel 222 and center hole 292 are subject to atmospheric pressure conditions. Similarly, via the passageway formed by the combined trigger port 117, manifold 107 trigger channel 241, and floor hole 251, since bleed hole 261 is relatively small compared thereto, the manifold 107 outer vacuum cavity 231' is also at substantially atmospheric pressure.

Now assume that a sheet of paper 302 is fed (see FIG. 1A, arrow 102) in a known manner onto the platen 103 surface 111 with the paper edge aligned to holddown 101 edge 104 such that a leading edge covers a trigger port 117. This is shown in FIG. 3B. Via the bleed hole 261, the vacuum force 300 pulls through the aligned and now closed trigger port 117 and manifold 107 inner trigger channel 241 and manifold 107 floor hole 251 on the diaphragm 237 via the manifold 107 outer vacuum distribution cavity 231' as a closed loop vacuum passageway circuit, building the vacuum force therein and forcing the diaphragm 237 from the lip seal 299 of the valve gate plate 105 inner vacuum distribution cavity 231. Consequently, the vacuum now has a wide pathway via the base plate 109 vacuum pull aperture 271, the manifold aperture 281 aligned therewith, and the valve gate plate 105 aperture 291 into the valve gate plate 105 outer vacuum distribution cavity 221, through the five vacuum ports 295, then through the center hole 292, and next through the valve gate plate 105 outer vacuum distribution cavity 222, the five associated vacuum port 113 and its associated set of five platen surface 111 channels 112. The manifold 107 outer vacuum distribution cavity 231', its floor hole 251, trigger channel 241, and trigger port 117 are still subject to vacuum 300 via the bleed hole 261. The vacuum force 300 is thereby able to keep the diaphragm 237 away from the lip seal 299. The vacuum is distributed across sectors having a covered trigger port 117 but no platen surface 111 sector having an open trigger hole has any vacuum pulling in the channels 112 thereof. That is, a vacuum condition is present automatically only through platen surface 111 sectors where a trigger port 117 has been covered. As different paper sizes will cover only certain trigger ports, only associated sectors are vacuum actuated.

For hard copy apparatus implementations, a cylindrical drum implementation is preferred as the leading edge of the sheet need only cover one trigger port for a vacuum sector to be actuated such that an entire leading region of the sheet is captured. As the drum turns, sequential regions of the sheet are laid across subsequent trigger ports, actuating the vacuum action for those regions and stopping when the trailing edge of the paper is captured. By having a drum circumference greater than the longest dimension of paper used with the apparatus and having at least one trigger port uncovered when such a sheet is captured, a subsequent sheet can be captured during off-loading of a currently captured sheet. Note that other implementations can be designed, such as a planar platen where the sheet is delivered above the platen and a leading edge then deposited vertically onto one or more trigger ports, depending on the media size.

The arrangement of the heretofore described channels, ports, apertures and cavities of the platen, gate valve plate, manifold and base plate in combination form a mechanism for manifolding the vacuum force to surface sectors depending upon whether that surface sector trigger port is open or covered. By placing trigger ports appropriately to the various size media expected to be used in the hard copy apparatus, the surface vacuum is appropriately limited to automatically accommodate all sizes without any user intervention to adjust the apparatus to current media in use.

Figure 4A:
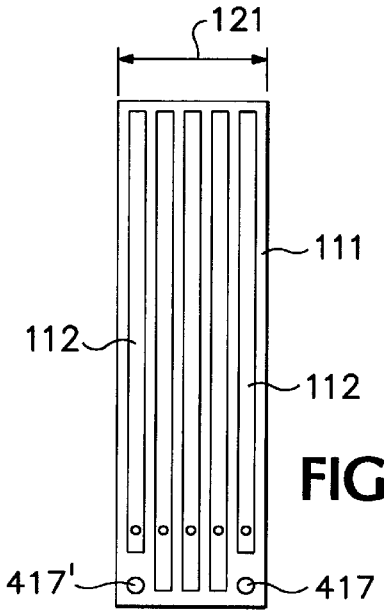
FIGS. 4A through 4E are schematic drawings demonstrating alternative, dual trigger port implementations for the present invention as shown in FIGS. 1A through 2C.
Figure 4B:
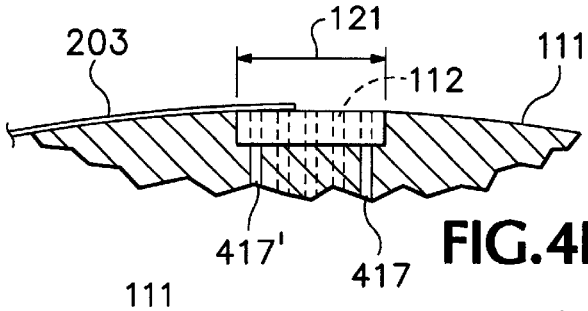

A modification of vacuum trigger port 117 placement on the platen 103 surface 111 for a vacuum drum implementation is shown in FIGS. 4A and 4B. It has been found to be advantages to have two trigger ports 417, 417' for each sector 121, 122, 123 of platen surface 111. One trigger port 417, 417' is placed at each edge of the array of vacuum channels 112 of the sector 121. If either trigger port 417, 417' is closed, a flow state is created equivalent to having both ports closed, so that the subjacent vacuum plenum valve apparatus formed by the mechanism for manifolding the vacuum force system of FIGS. 2A–2C is activated to provide a vacuum in the associated surface channels 112. Thus, the paper leading edge or trailing edge covering a sector of the surface 111 from either side activates the vacuum for that sector. This substantially eliminates the chance that either the leading edge or the trailing edge region of a sheet of paper is not exposed to vacuum holding.

Figure 4C:
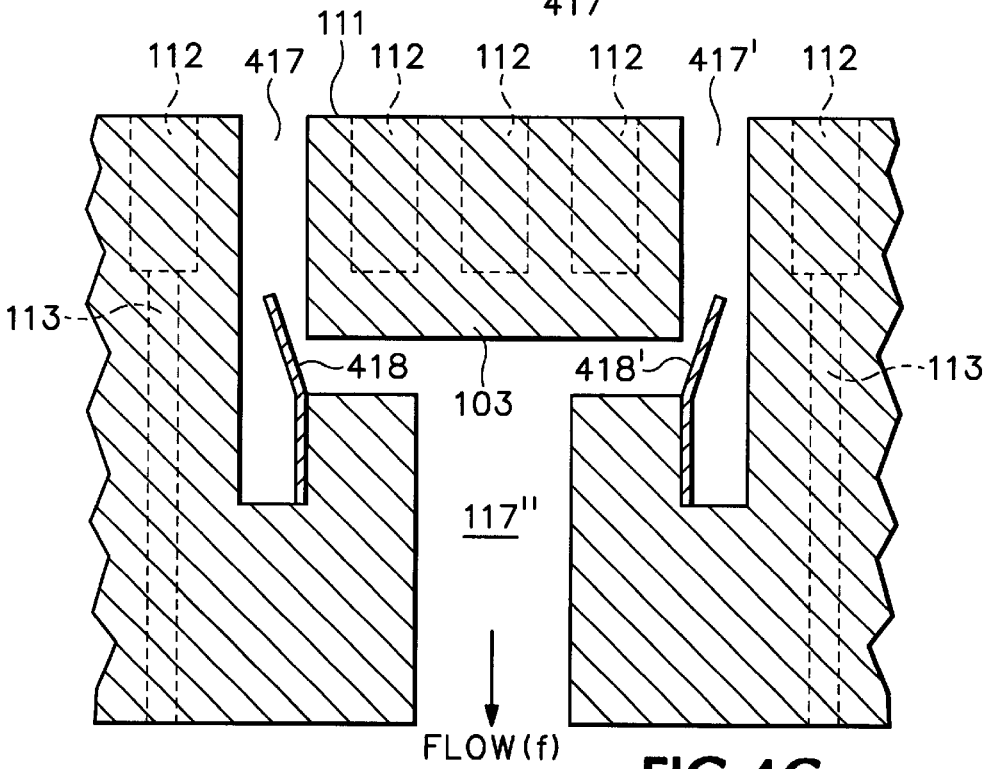

FIG. 4C schematically shows an implementation where the platen 103 surface has dual vacuum trigger ports 417, 417' with each trigger port 417, 417' having an integrated flap 418, 418'. Inwardly from the flaps 418, 418', the separate trigger ports 417, 417' combine into a single trigger passageway, or port, 417" configured and operating in the same manner as the trigger port 117 vacuum passageway of the embodiments of FIGS. 1A–3B. The vacuum pull flow is represented by an arrow labeled "FLOW (f)". The flaps 418, 418' are configured and biased to an open position such that when neither trigger port 417, 417' has paper covering it, the flow passed each flap is equal to half the total FLOW, or "f÷2" which is designed to be insufficient to deflect the flaps against the bias. Likewise, for FLOW(f) greater than f÷2, the design is such to deflect the flaps 418, 418' in the direction of the vacuum pull. Therefore, if either trigger port 418, 418' is covered, namely by a leading or trailing edge of paper, the flow through the uncovered port will increase until it reaches full force "f" and deflects the flap against its bias, closing the uncovered port passageway. Thus, the diaphragm vacuum plenum valve of the mechanism for manifolding the vacuum force is "signaled" that both trigger ports 417, 417' of the pair are closed and the holddown operation proceeds as demonstrated in FIGS. 3A and 3B.

Figure 4D:
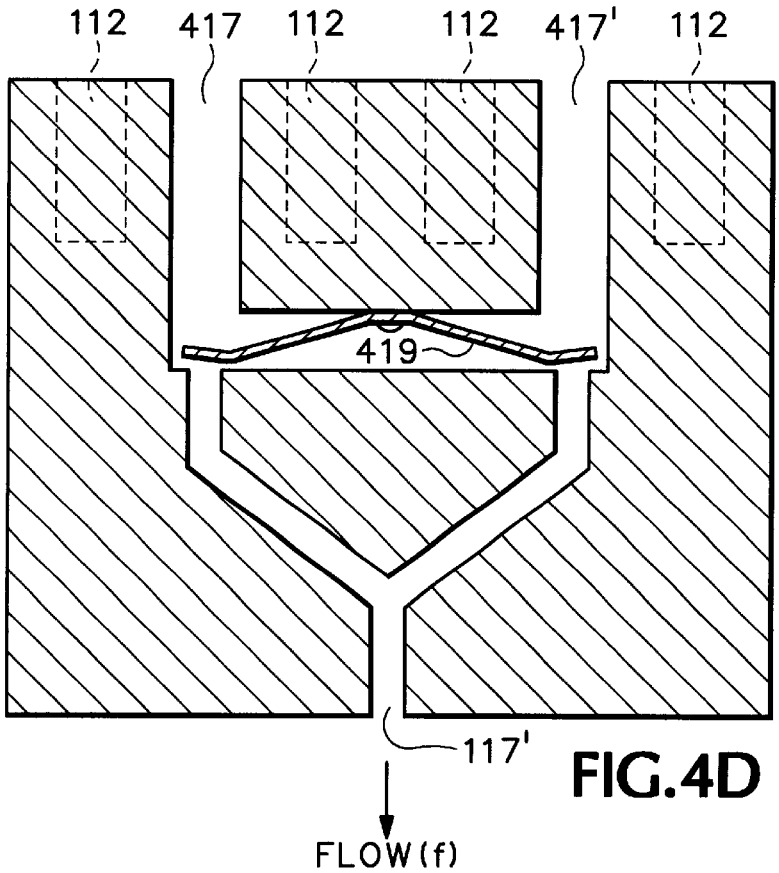

FIG. 4D schematically shows an alternative dual trigger port 417, 417' configuration using a center balanced spring 419 to function in place of the flaps 418, 418' of FIG. 4C. If either port 417, 417' is closed, the flow through the other port increases, tipping the spring 419 to close it also despite the lack of paper over it. Again, the diaphragm vacuum plenum valve of the mechanism for manifolding the vacuum force is "signaled" that both are closed and the operation proceeds as demonstrated in FIGS. 3A and 3B.

Figure 4E:
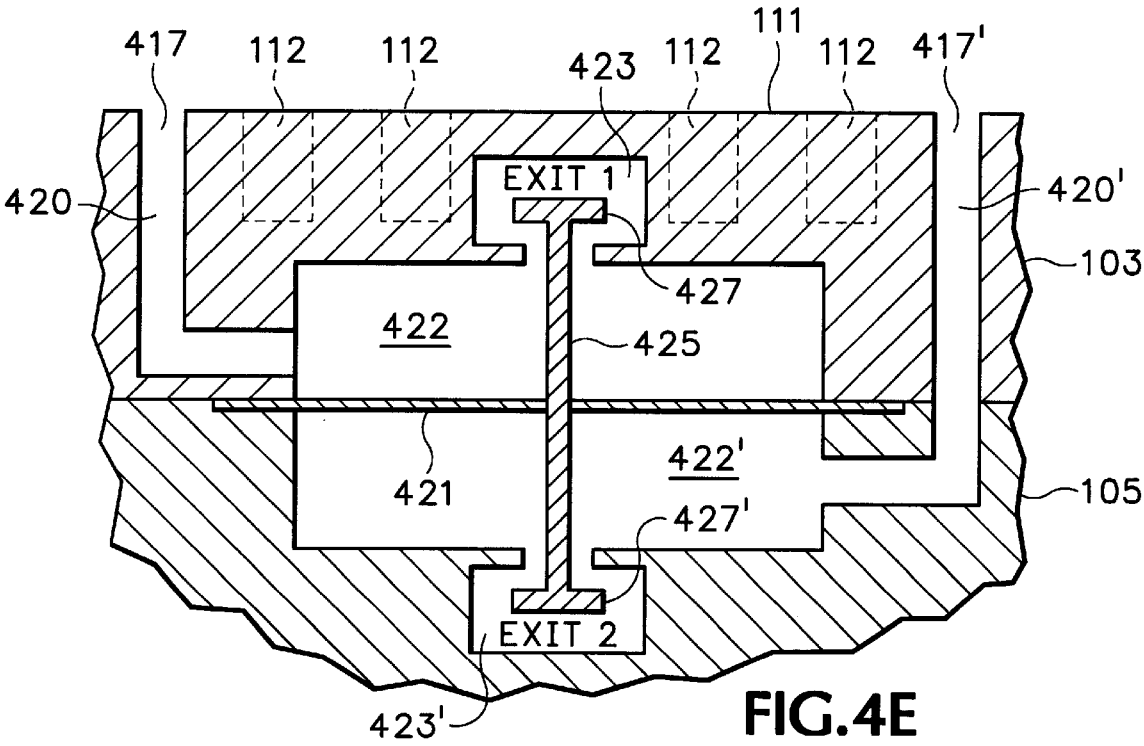

FIG. 4E schematically shows another dual trigger port 417, 417' configuration using a diaphragm balance 421 for separating a trigger vacuum chamber 422, 422' such that two exit passageways 423, 423'—depicted and also referred to as EXIT 1 and EXIT 2—from respective regions of the separated chamber are regulated to act as the trigger device for the diaphragm vacuum plenum valve of the mechanism for manifolding the vacuum force. A beam gate 425 is coupled to the center of the diaphragm balance 421 and is provided with two passageway stops 427, 427', one at each exit passageway 423, 423'. Each trigger port 417, 417' is fluidically coupled via an associated conduit 420, 420' to an opposite side of the diaphragm balance 421.

When no media is on the platen 103 surface 111, relative pressures are balanced on both sides of the diaphragm balance 421 and both passageways 423, 423' are open; that is, air at atmospheric pressure flows through both exit passageways 423, 423' to the diaphragm vacuum plenum valve of the mechanism for manifolding the vacuum force. When a sheet of media (not shown) on the platen 103 surface 111 covers both trigger ports 417, 417', the flow is stopped with the diaphragm balance 421 centered and, as explained hereinabove, the vacuum will pull through the trigger ports 417, 417', holding the paper in place. When a paper sheet's leading edge covers a trigger port 417, the flow is stopped and vacuum builds on top of the diaphragm balance 421 via the vacuum pull through the EXIT 1 passageway 423. The diaphragm balance 421 is deflected toward EXIT 1 until the passageway stop 427' of the beam gate 425 closes the EXIT 2 passageway 423, cutting off air flow from the trailing edge port 417' to the diaphragm vacuum plenum valve of the mechanism for manifolding the vacuum force, signaling that both trigger ports 417, 417' are closed. Similarly, if only the trailing edge of a sheet of media covers a trigger port 417', air flow through its associated conduit 420, 420' is stopped and vacuum builds in the trigger vacuum chamber 422' on the other side—the EXIT 2 side—of the diaphragm balance 421. As the vacuum pulls through the passageway 423' the diaphragm balance 421 is deflected in the opposite direction as when the leading edge port 417 was covered, moving the beam gate 425 until the EXIT 1 passageway stop 427 closes. With EXIT 1 sealed by the stop 427, flow is again cut off to the diaphragm vacuum plenum valve of the mechanism for manifolding the vacuum force, vacuum is transferred to the channels 112 in the surface.

FIG. 5 depicts an ink-jet printer 501 which employs a paper holddown 101' in accordance with the present invention. A housing 503 encloses the electrical and mechanical operating mechanisms of the printer 501. Operation is administrated by an electronic controller (usually a microprocessor or application specific integrated circuit ("ASIC") controlled printed circuit board, not shown) connected by appropriate cabling to the computer (not shown). It is well known to program and execute imaging, printing, print media handling, control functions, and logic with firmware or software instructions for conventional or general purpose microprocessors or ASIC's. Cut-sheet print media 505, loaded by the end-user onto an input tray 507, is fed by a suitable paper-path transport mechanism (not shown) in the Y-axis (see labeled arrow) to a vacuum drum holddown 101' which captures the sheet on platen 103' surface 111' in accordance with the foregoing described method and apparatus details and moves it to an internal printing station. A carriage 509, mounted on a slider 511, scans across the print medium in the X-axis (see labeled arrow). An encoder strip 513 and appurtenant known manner devices (not shown) are provided for keeping track of the position of the carriage 509 at any given time. A set of individual ink-jet pens, or print cartridges, 515 are releasably mounted in the carriage 509 for easy access and replacement (generally, in a full color system, inks for the subtractive primary colors, cyan, yellow, magenta (CYM) and true black (K) are provided). Each pen or cartridge 515 has one or more printhead mechanisms (not seen in this perspective) for "jetting" minute droplets of ink to form swaths of dots on adjacently positioned print media where graphical images or alphanumeric text are created using state of the art dot matrix manipulation techniques. [Note: a stationary, page-wide, ink-jet printing mechanism can also be employed.]

A variety of mechanisms for removing a sheet of paper being held on a vacuum holddown 101'—such as blowers, selectable lift fingers, and the like—are known in the art and can be employed in conjunction with the present invention. Further explanation of those mechanisms is not necessary to an understanding of the present invention.

As will be recognized by a person skilled in the art, the described embodiment can be altered to accommodate specific design needs. The platen size, the number of valves and associated number of vacuum channeling constructions in the platen can be altered to fit any particular implementation. In this sense, the preferred embodiment can be tailored to the specific design of the hard copy apparatus. In a wet dye printing apparatus, the dimensions of the channels and ports should be minimized such that print artifacts are not created by vacuum pulling wet dye through the capillaries of the medium.

Further, in ink-jet printing devices, the dimensions of the channels and ports and the vacuum force levels must be selected such that closely-spaced local deformations of the media surface are not created. Such local deformations can result in print artifacts when the inherent modification of pen-to-paper spacing interacts with ink droplet flight-time variations and trajectory errors.

While factors such as paper composition, dye composition, and the like as would be known to a person skilled in the art, will vary, it has been found that for commercial plain paper that a drum surface having features in the range of approximately 0.2 to 1.0 millimeter ("mm"), using a vacuum pressure force equivalent to five inches water column ("W.C.") on a diaphragm vacuum plenum valve of the mechanism for manifolding the vacuum force having a round diaphragm having a diameter of approximately 10 mm, provides acceptable performance. In general, the method and apparatus of arranging the diaphragm vacuum plenum valve of the mechanism for manifolding the vacuum force is to maximize the valves while controlling a small area of the surface of the plenum. By allowing each valve to extend under adjacent sets of surface vacuum channels, the valve diameter can be larger than the span of the channels, e.g., a 10 mm diaphragm for each sector of five channels having a cross-dimension of about 7.5 mm. (Thus it should be recognized that in FIG. 5, platen 103' channel 112' sizes are exaggerated for purposes of illustration.) To generalize, it has been found that an open/closed flow ratio of approximately 100:1 is appropriate. Staggering the location of each diaphragm vacuum plenum valve of the mechanism for manifolding the vacuum force as shown in FIGS. 2A–2C is beneficial as larger detail features of the specific valve design can reduce sensitivities to manufacturing and assembly tolerances.

Thus, the present invention provides a method and apparatus that detects the presence of paper on a platen surface and automatically turns on the vacuum to only those sectors of the surface covered. Tension in a valving mechanism caused by the pressure differential between the manifolded vacuum and atmospheric pressure is balanced such that there is no vacuum suction at the surface until the valving mechanism is triggered by a change in the pressure differential caused by a sheet of paper overlaying the surface.

It is known in the art that print media and associated hard copy apparatus are generally categorized as A-size, e.g, ranging from 5×7-inches to 8.5×l4-inches (or "legal"), and sequentially increasing to B-size, C-size and D-size which is for large engineering plots, blueprints and the like. The present invention can be adapted to each of these apparatus in accordance with general engineering principles and practices.

The foregoing description of the exemplary embodiment of the present invention has been presented for purposes of illustration and description. It is not intended to be exhaustive or to limit the invention to the precise form or to exemplary embodiments disclosed. Obviously, many modifications and variations—particularly for example in the manifold design—will be apparent to practitioners skilled in this art. Moreover, while the current best mode currently is shown in the nature of a multi-piece assembly or construction, unitary forms which can be designed using sophisticated, known manner molding techniques are also within the scope of the invention. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents.

What is claimed is:

1. An apparatus for receiving and holding a flexible material sheet thereon, the apparatus including a means for producing a vacuum, comprising:

means for receiving and holding said flexible material on a first surface, said first surface having a plurality of sectors wherein each of said sectors has associated therewith means for triggering ducting of a vacuum force from said means for producing a vacuum to each of the sectors respectively;

a plurality of means for containing a vacuum subjacent said surface, one means for containing a vacuum associated with each of said plurality of sectors, respectively, wherein each means for containing a vacuum is fluidically coupled to an individual one of said sectors; and means for manifolding the vacuum force from said means for producing a vacuum to said plurality of means for containing a vacuum such that when said means for triggering is open to atmospheric pressure said means for contain a vacuum is in a first state wherein no vacuum force is passed through to the one of said sectors associated with said means for triggering open to atmospheric pressure, and when said means for triggering is covered by said flexible material said means for containing a vacuum is in a second state wherein said vacuum force is passed through to said one of said sectors associated with said means for triggering closed to atmospheric pressure.

2. The apparatus as set forth in claim 1, each of said sectors further comprising:

plurality of vacuum channels extending across said surface without penetrating through said means for receiving and holding.

3. The apparatus as set forth in claim 2, each of said means for containing a vacuum further comprising:

a vacuum plenum chamber subjacent said surface and fluidically coupled by at least one passageway from each said vacuum chamber to said plurality of vacuum channels for the associated one of said sectors, said vacuum plenum chamber being segregated by a flexible member into a surface side cavity and a vacuum side cavity.

4. The apparatus as set forth in claim 3 further comprising:

said means for triggering moves said flexible member from said first position to said second position by forcing a pressure differential change across said flexible member.

5. The apparatus as set forth in claim 3 further comprising:

said means for triggering is activated by covering said means for triggering with a region of said sheet such that the flexible member is moved by said vacuum force to said first position when said means for triggering associated therewith is uncovered and such that the flexible member is moved by said vacuum force to said second position when said means for triggering associated is activated such that a vacuum condition exits in both said surface side cavity and said vacuum side cavity of said vacuum plenum chamber.

6. The apparatus as set forth in claim 5, further comprising:

said apparatus is construction in which said means for receiving and holding is a print media platen having said channels of said sectors arranged with respective longitudinal axes parallel to one another, said means for triggering is a vacuum trigger passageway, having a predetermined first diameter orifice at said surface, leading from said surface to said vacuum side cavity of said vacuum plenum chamber, said passageway further including a bleed hole, having a predetermined second diameter relatively smaller in diameter than said passageway, fluidically coupling said passageway to said means for producing a vacuum, and said channels having a fluidic coupling channel vacuum passageway from the channels to the surface side cavity of the vacuum plenum chamber.

7. The apparatus as set forth in claim 6 further comprising:

said first diameter and said second diameter have a size ratio to change the flow rate through said passageway by a factor of approximately 100:1 between the first position state and the second position state.

8. The apparatus as set forth in claim 6 further comprising:

said means for manifolding having a manifold passageway fluidically coupling said means for producing a vacuum to said surface side cavity of the vacuum plenum chamber;

means for cooperating with said flexible member for sealing off a first section of said manifold passageway fluidically coupled to channel vacuum passageway from said means for producing a vacuum when said flexible member is in said first position.

9. The apparatus as set forth in claim 8, said construction comprising:

a vacuum drum having a substantially cylindrical perimeter and a drum longitudinal axis parallel to said channel axes and is oriented such that said print media is transported to said drum wherein a leading edge and a trailing edge of said print media is parallel to said channel axes and said drum longitudinal axis and one side edge of said print media is proximate one end of said channels.

10. The apparatus as set forth in claim 9, said means for triggering further comprising:

a pair of vacuum trigger ports wherein one of said pair of ports is proximate said one end of said channels constituting a leading edge channel of all of said channels in an associated sector and a second of said ports is proximate a trailing edge channel of said channels in an associated sector.

11. A method for securing variably sized, individual sheets of print media to a platen surface using vacuum means for generating a vacuum force, comprising the steps of:

providing a platen having surface with a plurality of discrete vacuum channels therein wherein said channels are arranged in sets associated with discrete sectors of said surface, each of said channels being fluidically coupled by a passageway through said platen to one of a plurality of vacuum plenum chambers subjacent said surface wherein one of said vacuum plenum chambers is associated with each of said sets, said plenum chamber having a means for opening and closing said passageway and for segregating said chamber into an exterior region and an interior region, wherein said means for opening and closing is biased to a passageway-open position against atmospheric pressure and is pulled to a passageway-closed position when said vacuum force is manifolded to said exterior region, wherein said platen surface has length and width dimensions for sequentially accommodating different sized print media, and wherein said surface has at least one vacuum port associated with each of said sets fluidically coupled to said means for generating vacuum force;

subjecting each of said plenum chambers to said vacuum force via said exterior region, said vacuum force having a predetermined value sufficient for closing said passageways by moving said means for opening and closing to said passageway-closed position such that a substantially atmospheric pressure condition exists within passageways and channels associated therewith; and transporting a sheet of print medium onto said platen surface wherein by interaction of said sheet of print medium with said vacuum ports where said print medium is in contact with said platen surface, vacuum ports covered by said sheet of print media have said means for opening and closing automatically moved to said passageway-open position due to change in pressure differential between said exterior region and said interior region of said plenum chamber thereby securing said sheet to said surface.

12. A cut-sheet print medium holddown device for a hard copy apparatus having a means for exerting a vacuum force, the device comprising:

a platen having a platen outer surface having an area sufficient for sequentially accommodating different size print media sheets thereon and a plurality vacuum channels distributed thereon as discrete sets of vacuum channels, a platen inner surface, and a plurality of vacuum trigger ports fluidically coupling said platen outer surface and said platen inner surface with at least one vacuum trigger port associated with each of said discrete sets of vacuum channels;

a plurality of vacuum plenum chambers subjacent said platen, each of said chambers having at least one fluidic coupling to one of said discrete sets of vacuum channels;

a manifold for distributing the vacuum force from said means for exerting a vacuum force to said plenum chamber and for fluidically coupling said vacuum trigger ports from said platen inner surface to said vacuum plenum chambers such that each of said chambers is separately coupled to one of said discrete sets of vacuum channels and the trigger port associated therewith;

a plurality of vacuum plenum valves wherein one of said plurality of vacuum plenum valves is mounted within each of said vacuum plenum chambers such that print media sheet coverage of individual vacuum trigger ports causes a pressure differential change across only the vacuum plenum valves associated with the sheet-covered vacuum trigger ports fluidically coupled thereto, automatically moving said vacuum plenum valves associated with sheet-covered vacuum trigger ports from a closed position to an open position such that the vacuum force is exerted only through vacuum channels associated with sheet-covered vacuum ports.

13. The device as set forth in claim 12, wherein said device further comprises:

a curvilinear assembly.

14. The device as set forth in claim 13, wherein said curvilinear assembly comprises:

a vacuum drum having a longitudinal spin axis wherein said platen outer surface has circumferential and longitudinal dimensions for accommodating a range of print media sizes and said discrete sets of vacuum channels are arranged with respective channel longitudinal axes in parallel to said spin axis, said vacuum trigger port associated with each of said discrete sets of vacuum channels is distributed at one end of each of said discrete sets such that a sheet of said print media wrapped around said platen outer surface covers at least one of said plurality of vacuum trigger ports.

15. The device as set forth in claim 14, comprising:

each of said discrete sets of vacuum channels has two vacuum trigger ports, a leading edge trigger port and a trailing edge trigger port, said leading edge trigger port and said trailing edge trigger port having a fluidic coupling and a valving mechanism such that covering either said leading edge trigger port with a leading edge of said sheet or said trailing edge trigger port with a trailing edge of said sheet manifolds said vacuum force to close the other of said two vacuum trigger ports.

16. The device as set forth in claim 14, comprising:

each of said vacuum plenum valves is a diaphragm segregating a respective vacuum plenum chamber in which the diaphragm is mounted into a first chamber and a second chamber such that said first chamber is fluidically coupled by said at least one fluidic coupling to one of said discrete sets of vacuum channels and is fluidically coupled to said means for exerting a vacuum force, said second chamber has a second chamber fluidic coupling to a respective trigger port associated with each of said discrete sets of vacuum channels, said second chamber fluidic coupling having a vacuum bleed coupling to said means for exerting a vacuum force, and said diaphragm has a closed position when said respective trigger port is not covered by a sheet of print media such that no vacuum force is manifolded to said vacuum channels associated with said respective trigger port and an open position when said respective trigger port is covered by a sheet of print media such that the vacuum force is manifolded to said vacuum channels associated with said respective trigger port.

17. An ink-jet hard copy apparatus, having a vacuum means for generating a vacuum force, wherein the apparatus is adapted for using cut-sheet print media of different sizes, comprising:

a platen having an inner surface fluidically coupled to said vacuum means and an outer surface for receiving various sized print media thereon;

a manifold for coupling discrete sectors of said outer surface to said vacuum means;

a plurality of vacuum operated valves, mounted in said manifold such that each of said discrete sectors is individually coupled to said vacuum force through a respective valve associated with the individual one of said discrete sectors, each of said vacuum operated valves having a first position in which a respective one of the discrete sectors is cut-off from said vacuum force and a second position in which the respective one of the discrete sectors is coupled to said vacuum force; and a plurality of vacuum-actuated trigger ports through said platen, fluidically coupled to said vacuum means and to respective ones of said vacuum operated valves associated with a respective one of the discrete sectors, one each of said trigger ports associated with one of said discrete sectors such that covering a trigger port with a region of said print media changes a pressure differential between atmospheric pressure and said vacuum force across said valve such that said valve is moved from said first position to said second position.

18. The hard copy apparatus as set forth in claim 17, comprising:

said platen and said manifold form a vacuum drum.

19. The hard copy apparatus as set forth in claim 17, comprising:

said plurality of vacuum operated valves includes an arrangement of vacuum plenum diaphragm valves having a shape and dimensions to maximize size of each of said valves while controlling a minimized respective discrete sector area of the outer surface of the plenum.

20. A vacuum holddown comprising:

a drum having a surface for receiving and capturing cut-sheet print media of various sizes thereon wherein the surface is divided into individual sectors;

a vacuum manifold coupled to the drum;

at least one valve mechanism coupled to the manifold for valving a suction force to said individual sectors; and associated with each of said sectors, at least two related vacuum trigger port mechanisms for activating said valve mechanism including, a first vacuum trigger port mechanism located with respect to the associated sector for being covered by a leading edge of said cut-sheet print media and a second vacuum trigger port mechanism located with respect to the associated sector for being covered by a trailing edge of said cut-sheet print media wherein each of said vacuum trigger port mechanisms includes a means for closing a related vacuum trigger port mechanism whenever one of said two related vacuum trigger port mechanisms is covered by said cut-sheet print media.

* * * * *